United States Patent [19]

van der Meulen

[11] 3,987,336

[45] Oct. 19, 1976

[54] ARRANGEMENT INTENDED FOR THE IGNITION AND ALTERNATING CURRENT SUPPLY OF A GAS AND/OR VAPOR DISCHARGE TUBE

[75] Inventor: Andries van der Meulen, Drachten, Netherlands

[73] Assignee: U.S. Philips Corporation, New York, N.Y.

[22] Filed: Nov. 6, 1972

[21] Appl. No.: 304,061

[30] Foreign Application Priority Data

Nov. 12, 1971 Netherlands ..... 7115627

[52] U.S. Cl. ..... 315/101; 315/47; 315/203

[51] Int. Cl.[2] ..... H05B 41/22

[58] Field of Search ..... 315/59, 60, 202–204, 315/334–336, 101, 168, 171, 261, 47, 99

[56] References Cited

UNITED STATES PATENTS

| | | | |
|---|---|---|---|
| 2,263,171 | 11/1941 | Hays et al. | 315/47 |
| 2,619,615 | 11/1952 | Ruff et al. | 315/334 X |
| 3,619,711 | 11/1971 | Freese | 315/60 |
| 3,701,925 | 10/1972 | Nozawa | 315/101 |

FOREIGN PATENTS OR APPLICATIONS

| | | | |
|---|---|---|---|
| 586,074 | 12/1958 | Italy | 315/101 |
| 384,075 | 1/1965 | Switzerland | 315/99 |

*Primary Examiner*—John K. Corbin
*Assistant Examiner*—Richard A. Rosenberger
*Attorney, Agent, or Firm*—Frank R. Trifari; Bernard Franzblau

[57] ABSTRACT

The invention relates to an ignition circuit for a sun-lamp, the lamp including a gas or vapor discharge tube which emits ultraviolet radiation and two infrared radiators.

The ignition or auxiliary circuit uses a diode which supplies a succession of current pulses which flows through a heating resistor in the discharge tube for the purpose of ignition. Relatively high voltages between the electrodes of an electric discharge tube, for example, this discharge tube can be realized.

19 Claims, 2 Drawing Figures

Figure 1:
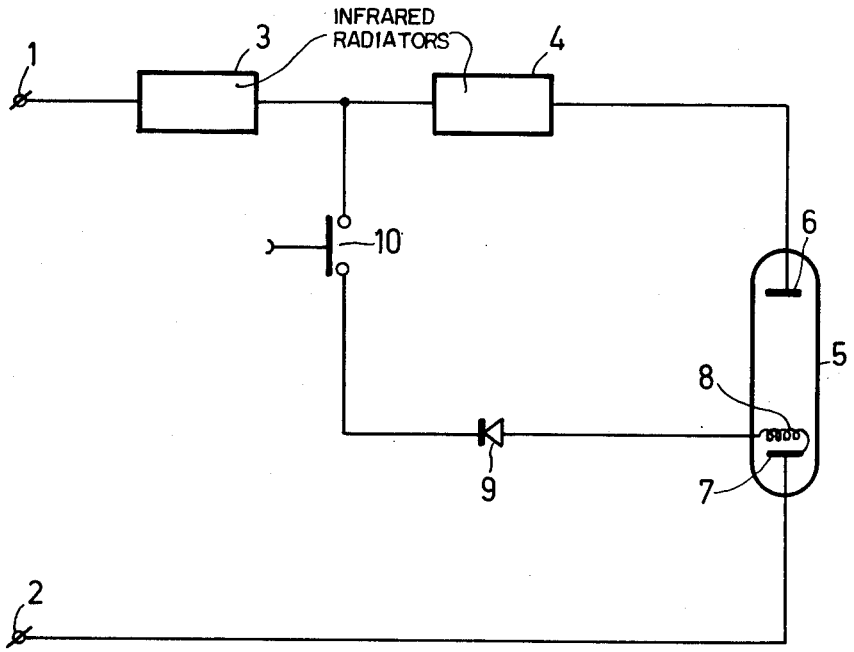

ARRANGEMENT INTENDED FOR THE IGNITION AND ALTERNATING CURRENT SUPPLY OF A GAS AND/OR VAPOR DISCHARGE TUBE

The invention relates to an arrangement for the ignition and alternating current supply of a gas and/or vapor discharge tube. In such an arrangement, the supply circuit is basically a series circuit connecting the input terminals with the discharge tube and a stabilizing element. The stabilizing element has at least a portion having a resistive character, which resistive portion is formed as a radiation source. The discharge tube includes a pair of electrodes and a heating resistor which is located near one of the electrodes or forms a part thereof. An auxiliary branch which includes the heating resistor shunts a portion of the series arrangement including at least the tube discharge path for the purpose of igniting the discharge tube. The auxiliary branch in its shunting condition is in series with a portion of the radiation source.

A known arrangement of the kind mentioned above is described, for example, in French Pat. No. 1,109,053. This patent refers to a sunlamp.

In the embodiment described in the French Patent Specification, the heating resistor in the discharge tube forms part of an electrode in this tube. In another known sunlamp which has been realized in practice, the heating resistor in the discharge tube was present near one of the tube electrodes.

The purpose of the heating resistor in either configuration is to introduce, by means of heating this resistor with an electric current, a plurality of electrons into the discharge tube so that the ignition thereof is enhanced. For this purpose, the auxiliary branch including the heating resistor is switched "ON" for a short period. This may be effected, for example, with the aid of a push-button switch.

A drawback of the known arrangement which is described in the French Patent is that the potential difference between the two electrodes in the discharge tube is nearly zero in the switched-on condition of the heating resistor and that this potential difference can only achieve a high value in the switched-off condition of the heating resistor. This is a limitation in obtaining a satisfactory ignition.

In the other known arrangement in which the heating resistor is near an electrode, the auxiliary branch includes a further resistor so as to limit the current intensity in this auxiliary branch. In the shunting condition of the auxiliary branch, this branch was, however, not in series with the radiation source of a resistive character mentioned above. A drawback of this second known arrangement is the complication of the additional resistor which leads to additional electrical losses during the starting procedure of the discharge tube and which in addition—as has been proved in practice — may burn out when the auxiliary branch is maintained switched on for a long period. This second arrangement did have, however, the advantage that the full A.C. supply voltage appeared initially between the tube electrodes before the auxiliary branch, and hence the heating resistor, was switched off by releasing the push-button switch.

It is an object of the invention to provide an arrangement as described in the first paragraph of this specification in which the advantage of ignition, i.e. the appearance of the full supply voltage between the tube electrodes before the auxiliary branch is switched off, is obtained but without the use of an additional resistor in the auxiliary branch.

According to the invention, an arrangement for the ignition and alternating current supply of a gas and/or vapor discharge tube comprises means for supplying a source of alternating current to a discharge tube having a pair of electrodes and a heating element near one of the electrodes. Included is a stabilizing element, at least a portion of which is resistive and formed as a radiation source, arranged in series with the supply means and discharge tube. An auxiliary branch circuit is also included for igniting the discharge tube by shunting at least a portion of the series arrangement including at least the tube discharge path, the auxiliary branch including the heating element, a diode in series with the heating element, and, during the shunting condition, the auxiliary branch being in series with the resistive portion of the stabilizing element. Finally, means are included in the arrangement for maintaining the auxiliary branch circuit in a shunt condition for a predetermined time during ignition.

An advantage of this arrangement is that during the starting or ignition procedure of the discharge tube, pulses of current flow repeatedly through the heating resistor and, further, the full supply voltage is present between the tube electrodes. The rate at which this is effected is determined by the frequency of the alternating voltage supply. An electric current — in the pass direction of the rectifier — flows through the auxiliary branch and hence through the heating resistor during one half of half periods (for example, the odd half periods) of the alternating supply voltage between the input terminals of the arrangement, whereas during the other half of half periods (the even half periods) the current in the circuit is zero due to the blocking action of the diode and thereby the full supply voltage is present between the tube electrodes.

It is to be noted that it is known per se to use an auxiliary branch which includes a rectifier for the ignition of a discharge tube, which branch shunts at least the discharge path of this tube and in which a heating resistor in this auxiliary branch forms part of an electrode in the said discharge tube; see for example German Pat. No. 1,119,410. In the arrangements according to this German patent, the auxiliary branch is, however, in series with an inductive impedance. This means that the current flowing through the diode continues for much longer than half a period of the alternating supply voltage during the starting process so that the current becomes zero only at a late instant during the next half period. Only at that late instant can the supply voltage appear between the tube electrodes. The instantaneous value of the supply voltage will then, however, be much lower than the peak value of this voltage. It is evident that the manner of ignition of the lamp mentioned in the German Pat. No. 1,119,410 is therefore quite different from that according to the present invention. In fact, the German Patent mentions the use of a voltage peak which is generated with the aid of the inductive impedance by interrupting the current in the auxiliary branch.

In an arrangement according to the invention, the discharge tube may be formed, for example, as a discharge lamp. The radiation source having a resistive character may be formed, for example, as an incandescent lamp. A part of the stabilizing element, which is not in series with the auxiliary branch, which element acts to stabilize the discharge in the discharge tube, may be formed, for example, as either a resistive stabilizing element or as an inductive stabilizing element. It is to be noted that this part of the stabilizing element only conveys current in the ignited condition of the discharge tube.

An arrangement according to the invention is preferably formed as an irradiating device in which the discharge tube is a high-pressure mercury vapor discharge tube for emitting ultra-violet radiation and in which the radiation source having a resistive character is an infrared radiator. The stabilizing element not only preferably includes the infrared radiator but also a second infrared radiator which is substantially equal thereto. The part of the series arrangement to be shunted by the auxiliary branch not only comprises the tube discharge path but also the second infrared radiator.

An advantage of this preferred arrangement is that a sunlamp can be obtained which has a simple yet highly effective ignition circuit.

The last-mentioned preferred arrangement according to one embodiment of the invention may be designed so that the resistive value of each of the two infrared radiators is approximately 17 ± 2 ohm and the discharge tube is proportioned for approximately 80 watts.

An advantage of this arrangement is that it can be ignited and operated on an alternating voltage supply of 110 volts.

As already noted, the auxiliary branch may be maintained in the shunting condition for a short period by means of a pushbutton.

In a further preferred arrangement according to the invention, the means for maintaining the auxiliary branch in the shunting condition for a short period consists of a second resistor in the auxiliary branch, which resistor has a positive temperature characteristic.

An advantage of this preferred arrangement is that rendering the auxiliary branch inoperative is effected completely automatically. This results from the resistor having a positive temperature characteristic, which at first is at a low resistive value, and will experience a temperature rise during ignition of the tube and thereby becomes more highly resistive.

This resistor may be maintained at a high temperature, for example, by applying a residual current through it and/or by arranging the resistor in close thermal contact with the discharge tube. In the latter case, the ignited and heat-evolving tube will also increase the temperature of the resistor and will thereby cause a higher resistance to occur.

It is feasible that an arrangement according to the invention can be provided with a second auxiliary branch where both branches are equipped with a rectifier. In that case, for example, a heating resistor near each of the tube electrodes may be preheated. For obtaining the desired potential difference between the tube electrodes during starting of the tube, the direction of the two rectifiers will then have to be chosen so that they convey current simultaneously.

Figure 2:
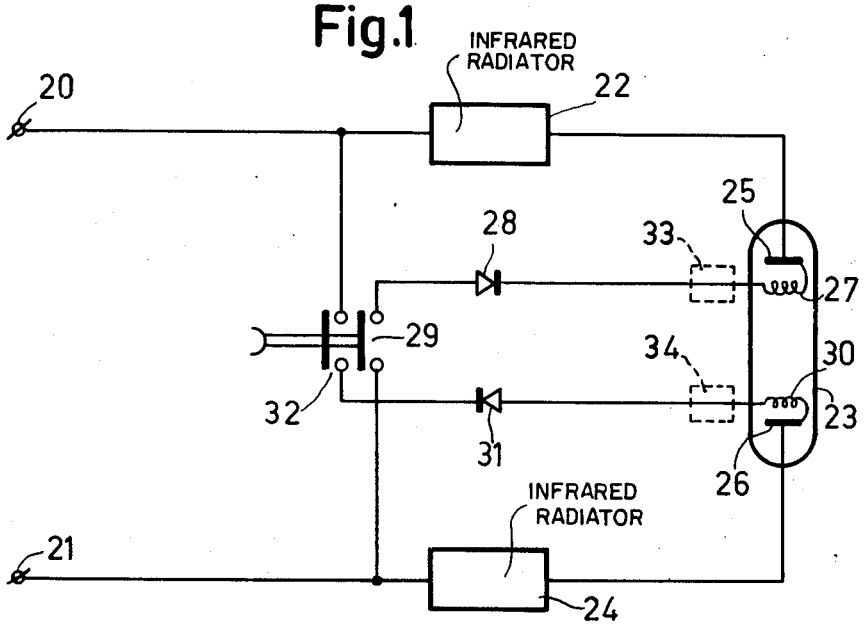

In order that the invention may be readily carried into effect, some embodiments thereof will now be described in detail, by way of example, with reference to the accompanying diagrammatic drawing in which:

FIG. 1 shows an electrical circuit diagram of an arrangement according to the invention; and FIG. 2 shows an electrical circuit diagram of a second arrangement according to the invention.

In FIG. 1, reference numerals 1 and 2 denote input terminals of a sunlamp intended to be connected to an alternating voltage supply of approximately 110 volts, 50–60 Hertz. The terminals 1 and 2 are connected by a series arrangement of an infrared radiator 3, an infrared radiator 4 and a high-pressure mercury vapor discharge tube 5 which in its operating condition emits ultraviolet radiation.

The discharge tube 5 is provided with two electrodes 6 and 7. A heating resistor 8, one end of which is electrically connected to the electrode 7, is located near the electrode 7 in the discharge tube 5. The other end of the heating resistor 8 is connected through a diode 9 and a push-button contact 10 to the connection between the two infrared radiators 3 and 4.

The branch including the circuit elements 8, 9 and 10 is indicated as the auxiliary branch.

The ignition process of the discharge tube 5 is as follows.

The push-button 10 is initially depressed for some time. As a result, a current flows in the circuit elements 2, 8, 9, 10, 3 and 1 during the half periods when terminal 2 is positive relative to terminal 1. This current heats the resistor 8 which thereby starts to emit electrons in the tube 5. During the half period when the terminal 1 is positive relative to the terminal 2, no current flows through the circuit and the full supply voltage is present between the tube electrodes 6–7.

After the resistor 8 is heated sufficiently, the voltage between the electrodes 6 and 7 will be sufficient to ignite the tube 5. The push-button 10 is released and the tube 5 operates in series with the infrared radiators 3 and 4 which also ensure the stabilization of the discharge current. Thus, partly ultraviolet radiation originating from tube 5 and partly infrared radiation originating from the radiators 3 and 4 is emitted with this sunlamp.

In a practical embodiment, the resistive value of each of the two infrared radiators 3 and 4 was approximately 17 ohms and the discharge tube 5 consumed approximately 80 watts in the operating condition. The resistance of the heating resistor 8, formed as an incandescent filament, was approximately 3.5 ohms in the hot condition. The ignition voltage of the discharge tube 5 was 95 volts an average in the completely heated condition of resistor 8 and the operating voltage was approximately 51 volts. Upon connection to a 110 volt supply, the current intensity in the operating condition was approximately 2.2 amperes.

An additional resistor is absent in the auxiliary branch 8, 9, 10 so that both the risk of burning out such a resistor and of additional electrical losses during the ignition process are prevented.

FIG. 2 shows an electrical circuit diagram of a second sunlamp. In this Figure, reference numerals 20 and 21 denote the input terminals which are also intended for connection to an alternating voltage supply of 110 volts, 50–60 Hertz. Terminals 20 and 21 are connected to the series circuit consisting of an infrared radiator 22, a high-pressure mercury vapor discharge tube 23 which emits ultraviolet radiation in its operating condition, and a second infrared radiator 24. Elements 25 and 26 are two electrodes in the tube 23. A heating resistor 27, one end of which is electrically connected to the electrode 25, is present near electrode 25. The other end of the resistor 27 is connected through a diode 28 and a contact 29 of a ganged pair of push-button contacts to the connection between the infrared radiator 24 and the supply terminal 21.

The parts 27 to 29 inclusive are associated with the first auxiliary branch.

A second heating resistor 30, one end of which is electrically connected to the electrode 26, is located near the electrode 26. The other end of the resistor 30 — in a manner corresponding to that for the first auxiliary branch — is connected through a diode 31 and a further contact 32 of the ganged pushbutton contact to the connection between the infrared radiator 22 and the supply terminal 20.

The elements 30, 31 and 32 are associated with the second auxiliary branch.

The ignition procedure for igniting the discharge tube 23 is similar to that for the ignition of tube 5 of FIG. 1. The difference is, however, that in the circuit of FIG. 2, the two auxiliary branches 29, 28, 27 and 30, 31, 32 start to conduct current upon depression of the push-button so that the two resistors 27 and 30 are heated and start to emit electrons. These currents only flow when the terminal 21 is positive relative to terminal 20. In case of an inverted polarity (terminal 20 positive relative to terminal 21) the full supply voltage is present between the tube electrodes 25 and 26 because the diodes 28 and 31 now block the current. When the resistors 27 and 30 are sufficiently heated, the voltage across the electrodes 25, 26 will be sufficient to ignite the tube 23. The push-button is released and the two auxiliary branches then do not conduct current. Subsequently, in a manner approximately corresponding to that described with reference to FIG. 1, the tube 23 operates in series with the two infrared radiators 22 and 24.

In lieu of the push-button switch 29, 32, it is feasible to include in each auxiliary branch a resistor having a positive temperature characteristic (P-T-C-resistor); see the resistors 33 and 34 shown in broken lines which have a low-resistive value in the cold condition and a high resistive value in the hot condition (for example, by heating the PTC resistors through the operating discharge tube 23) and consequently render the auxiliary branches substantially inoperative.

What is claimed is:

1. An arrangement for the ignition and alternating current supply of an electric discharge tube comprising, means for supplying a source of alternating current; a discharge tube including a pair of electrodes and a heating element adjacent one of the electrodes; stabilizing element means at least a portion of which is resistive and formed as a radiation source, said stabilizing element means being connected in series with said supply means and discharge tube; an auxiliary branch circuit for igniting the discharge tube by shunting at least a portion of the series stabilizing element means and the tube discharge path, the auxiliary branch including said heating element, a diode in series with said heating element and, during the shunting condition, the auxiliary branch being in series with said resistive portion of said stabilizing element means; and means for maintaining the auxiliary branch circuit in a shunt condition for a predetermined time during ignition.

2. The arrangement of claim 1 wherein said heating element is formed as a part of one of the electrodes.

3. The arrangement as claimed in claim 1 wherein said discharge tube is formed as a high-pressure mercury vapor discharge tube for emitting ultraviolet radiation and the radiation source having a resistive portion is formed as an infrared radiator, the stabilizing element means comprising not only the infrared radiator but also a second infrared radiator which is substantially equal thereto, wherein the portion of the series stabilizing element means shunted by the auxiliary branch includes the second infrared radiator.

4. An arrangement as claimed in claim 3 wherein the resistive value of each of the two infrared radiators is approximately $17 \pm 2$ ohms and the discharge tube is proportioned to dissipate approximately 80 watts.

5. An arrangement as claimed in claim 1 wherein the means for maintaining the auxiliary branch in the shunting condition for said predetermined period comprises a second resistor in the auxiliary branch, said resistor having a positive temperature characteristic.

6. A system for igniting an electric discharge lamp comprising, a pair of input terminals adapted for connection to a source of AC current, an electric discharge lamp including a pair of spaced electrodes and a heating element located adjacent one of said electrodes, stabilizing impedance means having a part with a resistive characteristic, means connecting said impedance means and said discharge lamp in series circuit across said input terminals, a rectifier element, an auxiliary branch circuit comprising said heating element in series with said rectifier element, and circuit means for connecting said auxiliary branch circuit in shunt with a part of the series circuit including at least the lamp discharge path and in series with a part of the impedance means having a resistive characteristic.

7. A system as claimed in claim 6 wherein said circuit means further comprises switching means for selectively connecting said auxiliary circuit in shunt with said part of the series circuit for a short time period sufficient to ignite conduction in the discharge lamp.

8. A system as claimed in claim 7 wherein said switching means comprises a PTC resistor connected in series with the heating element and the rectifier element in said branch circuit.

9. A system as claimed in claim 6 wherein said circuit means further comprises a PTC resistor connected in the auxiliary branch circuit in series with the rectifier element and the heating element.

10. A system as claimed in claim 9 further comprising a second heating element located adjacent the other one of the lamp electrodes and a second auxiliary branch circuit comprising a second rectifier element and a second PTC resistor in series with said second heating element, and said circuit means further comprises means for connecting said second branch circuit in shunt with a part of the series circuit including at least the lamp discharge path and in series with a second part of the impedance means having a resistive characteristic.

11. A system as claimed in claim 10 wherein said first and second rectifier elements are connected in circuit and are polarized so as to conduct current during the same half period of the AC current at the input terminals.

12. A system as claimed in claim 6 wherein said impedance means comprises first and second series connected impedance elements, and said circuit means connects the auxiliary branch circuit in shunt with the series arrangement of the second impedance element and the lamp discharge path and also in series with the first impedance element across the input terminals.

13. A system as claimed in claim 12 wherein said circuit means further comprises switching means for selectively connecting said auxiliary branch circuit to a junction point between said first and second impedance elements, and said first impedance element comprises the part of the impedance means having the resistive characteristic.

14. A system as claimed in claim 13 wherein said switching means comprises a PTC resistor connected in series with the heating element and the rectifier element in said branch circuit.

15. A system as claimed in claim 6 wherein said heating element is located within the lamp and is electrically connected to said one electrode.

16. A system as claimed in claim 6 wherein said impedance means includes a second impedance part, said first and second impedance parts being connected in series, in the order named, between one input terminal and the other lamp electrode, and said circuit means connects the branch circuit between the one lamp electrode and the junction point between said first and second impedance parts.

17. A system as claimed in claim 16 wherein said circuit means further comprises switching means for selectively connecting said auxiliary circuit in shunt between the one lamp electrode and said junction point during a lamp ignition operation and breaks said shunt connection subsequent to the lamp ignition.

18. A system as claimed in claim 6 further comprising a second heating element located adjacent the other one of the lamp electrodes and a second auxiliary branch circuit comprising a second rectifier element in series with said second heating element, and said circuit means further comprises switching means for selectively connecting said first and second auxiliary branch circuits in shunt with different parts of the series circuit, each part including the lamp discharge path and a portion of said impedance means.

19. A system as claimed in claim 6 wherein the resistive part of said stabilizing impedance means comprises an infrared energy radiation source and said discharge lamp comprises a mercury vapor discharge tube adapted to emit ultraviolet radiation.

* * * * *